US008258689B2

(12) United States Patent
Kakisaka et al.

(10) Patent No.: US 8,258,689 B2
(45) Date of Patent: Sep. 4, 2012

(54) ILLUMINATING DEVICE

(75) Inventors: Shunsuke Kakisaka, Osaka (JP); Hiroshi Nohara, Hyogo (JP); Makoto Inoue, Hyogo (JP)

(73) Assignee: Panasonic Corporation, Osaka (JP)

( * ) Notice: Subject to any disclaimer, the term of this patent is extended or adjusted under 35 U.S.C. 154(b) by 30 days.

(21) Appl. No.: 12/935,555

(22) PCT Filed: Apr. 24, 2009

(86) PCT No.: PCT/JP2009/001898

§ 371 (c)(1), (2), (4) Date: Sep. 29, 2010

(87) PCT Pub. No.: WO2009/130914

PCT Pub. Date: Oct. 29, 2009

(65) Prior Publication Data

US 2011/0025184 A1 Feb. 3, 2011

(30) Foreign Application Priority Data

Apr. 25, 2008 (JP) ..... 2008-115064

(51) Int. Cl.
*H01J 5/48* (2006.01)

(52) U.S. Cl. ..... 313/318.03; 313/318.04; 313/318.11

(58) Field of Classification Search ..... 313/113, 313/318.03, 318.04, 318.11
See application file for complete search history.

(56) References Cited

U.S. PATENT DOCUMENTS

| | | | | |
|---|---|---|---|---|
| 5,600,198 | A * | 2/1997 | Meade et al. | 313/318.01 |
| 5,616,984 | A * | 4/1997 | Guthier | 313/318.04 |
| 2002/0017842 | A1 * | 2/2002 | Narita | 313/13 |
| 2002/0067116 | A1 * | 6/2002 | Duggan et al. | 313/318.08 |
| 2007/0182333 | A1 | 8/2007 | Kakisaka et al. | |
| 2009/0045745 | A1 | 2/2009 | Kakisaka et al. | |
| 2009/0085484 | A1 | 4/2009 | Kakisaka et al. | |

FOREIGN PATENT DOCUMENTS

| | | |
|---|---|---|
| JP | H1-172210 | 5/1988 |
| JP | 2007-179959 | 7/2007 |
| JP | 2008-71761 | 3/2008 |
| WO | 2006/001166 | 1/2006 |

* cited by examiner

*Primary Examiner* — Bumsuk Won

(57) ABSTRACT

To aim to provide a lighting apparatus that is compact yet easy in lamp replacement. A lighting apparatus 1 comprises: a lamp 6 including an outer tube 13 and an arc tube 15 provided inside the outer tube 13; and an opening-type lighting fixture 3 having a mirror part 11 having a concave reflective surface 9 inside which the lamp 6 is disposed. The mirror part 11 reflects light emitted from the lamp 6 at the reflection surface 9 such that the reflected light is emitted through an opening 10 of the mirror part 11. Relational expressions $22 \leqq r \leqq 28$, $R \leqq 130$, and $3.5 \leqq R/r$ are satisfied, with r denoting a maximum outer diameter [mm] of the outer tube 13, and R denoting an opening diameter [mm] of the mirror part 11.

4 Claims, 8 Drawing Sheets

FIG. 5

| | Maximum outer diameter r [mm] | Opening diameter R [mm] | R/r | Rotational torque [N・m] | Judgment Easy/Difficult |
|---|---|---|---|---|---|
| Comparative Example 1 | 20 | 68 | 3.4 | 0.30 | Easy |
| Comparative Example 2 | 20 | 71 | 3.6 | 0.40 | Easy |
| Comparative Example 3 | 20 | 73 | 3.7 | 0.40 | Easy |
| Comparative Example 4 | 20 | 100 | 5.0 | 0.80 | Easy |
| Comparative Example 5 | 20 | 130 | 6.5 | 1.00 | Easy |
| Comparative Example 6 | 22 | 73 | 3.3 | 0.10 | Difficult |
| Example 1 | 22 | 77 | 3.5 | 0.40 | Easy |
| Example 2 | 22 | 100 | 4.5 | 0.80 | Easy |
| Example 3 | 22 | 130 | 5.9 | 1.00 | Easy |
| Comparative Example 7 | 25 | 85 | 3.4 | 0.20 | Difficult |
| Example 4 | 25 | 87 | 3.5 | 0.50 | Easy |
| Example 5 | 25 | 100 | 4.0 | 0.80 | Easy |
| Example 6 | 25 | 130 | 5.2 | 1.00 | Easy |
| Comparative Example 8 | 28 | 95 | 3.4 | 0.20 | Difficult |
| Example 7 | 28 | 98 | 3.5 | 0.60 | Easy |
| Example 8 | 28 | 120 | 4.3 | 0.80 | Easy |
| Example 9 | 28 | 130 | 4.6 | 0.90 | Easy |
| Comparative Example 9 | 30 | 98 | 3.3 | 0.50 | Easy |
| Comparative Example 10 | 30 | 100 | 3.3 | 0.50 | Easy |
| Comparative Example 11 | 30 | 120 | 4.0 | 0.70 | Easy |
| Comparative Example 12 | 30 | 130 | 4.3 | 0.80 | Easy |

ILLUMINATING DEVICE

TECHNICAL FIELD

The present invention relates to a lighting apparatus.

BACKGROUND ART

Recently, a high-pressure discharge lamp such as a metal halide lamp is becoming widespread as a light source of a lighting apparatus that is used as a downlight, a spotlight, or the like in commercial facilities for example. Also, store spaces especially needs only "light", and do not hope lighting apparatuses to be brought into prominence. That is, there arises a strong demand for size reduction of lighting apparatuses.

Also, there arises a demand for ease of maintenance such as easy lamp replacement. According to a conventional lighting apparatus that includes a compact metal halide lamp having a double-tube structure of an arc tube and an outer tube, a front glass is attached to a mirror part constituting the lighting apparatus so as to cover an opening of the mirror part via which light is emitted (light extraction part). This front glass is attached because in order to, even if the arc tube and the outer tube covering the arc tube are both broken, prevent scattering of broken pieces of the arc tube and the outer tube. However, the lighting apparatus with such a structure has a problem that lamp replacement is troublesome in attachment and detachment of the front glass. On the other hand, there has been known a lighting apparatus including an explosion preventive sleeve provided between an arc tube and an outer tube. According to the lighting apparatus with such a structure, a front glass is unnecessary. However, a lamp itself instead is increased in size compared with a metal halide lamp having a double-tube structure, and accordingly cannot satisfy the strong demand for size reduction described above.

Also, there has been proposed a compact metal halide lamp having a triple-tube structure of an arc tube, an inner tube, and an outer tube (for example, Patent Literatures 1 and 2). In the case where such a metal halide lamp is used for a lighting apparatus, a front glass is unnecessary because of the lamp having the triple-tube structure. This leads to an excellent maintenance property.

Furthermore, this provides an advantage that since the lamp itself is compact, the lighting apparatus can be also downsized.

Commercialization of a metal halide lamp having such a triple-tube structure provides a metal halide lamp having an outer tube whose outer diameter is approximately 20 [mm] and a rated lamp wattage of 35 [W], 70 [W], or the like.

CITATION LIST

Patent Literature

[Patent Literature 1] International Publication No. 2006/001166 pamphlet

[Patent Literature 2] Japanese Patent Application Publication No. 2007-179959

SUMMARY OF INVENTION

Technical Problem

According to a compact lighting apparatus that includes a conventional metal halide lamp having a triple-tube structure, a user can insert his hand inside the lighting apparatus through an opening of a mirror part so as to grasp the lamp. Accordingly, lamp replacement is performed with no problem. In order to increase the lamp wattage, there has made a lamp including an outer tube whose outer diameter is large (specifically, a lamp including an outer tube whose outer diameter of 20 [mm] has been increased to 22 to 28 [mm]). However, attachment of this lamp to a lighting apparatus has resulted in a problem of difficulty in lamp replacement.

This is because the large outer diameter of the outer tube narrows a space between the mirror part and the lamp in the lighting apparatus, and as a result the user has difficulty inserting his hand into the space and turning the lamp for detachment and attachment.

One of methods of solving this problem is to increase an opening diameter of a mirror part of the lighting apparatus. However, in order to keep the lighting apparatus compact, it is preferable to decrease both the opening diameter and a depth of the mirror part as far as possible.

The present invention has been made in view of the above problems, and aims to provide a lighting apparatus that is compact yet easy in lamp replacement.

Solution to Problem

The present invention provides a lighting apparatus comprising: a high-pressure discharge lamp that includes an outer tube and an arc tube provided inside the outer tube; and an open-type lighting fixture that includes a mirror part having a concave reflection surface inside which the high-pressure discharge lamp is disposed, the mirror part reflecting light emitted from the high-pressure discharge lamp at the reflection surface such that the reflected light is emitted through an opening of the mirror part, wherein relational expressions $22 \leqq r \leqq 28$, $R \leqq 130$, and $3.5 \leqq R$ are satisfied, with r denoting a maximum outer diameter [mm] of the outer tube, and R denoting an opening diameter [mm] of the mirror part.

Here, the "opening-type" lighting fixture indicates a lighting fixture in which a front glass is not attached to an opening of a mirror part through which light is emitted (light extraction part) and the mirror part is not closed.

Also, the "opening diameter" of the mirror part indicates an inner diameter of an end surface of the mirror part in a light emitting direction.

Advantageous Effects of Invention

According to the lighting apparatus having the above structure, the ratio (R/r) of the opening diameter "R" of the mirror part to the maximum outer diameter "r" of the outer tube is set to 3.5 or greater. This prevents that a user has difficulty inserting his thumb and fingers into a space between the mirror part and the outer tube, thereby prevent difficulty of lamp replacement. The basis for this is described later.

The present invention can realize a compact lighting apparatus that is excellent in easy lamp replacement.

BRIEF DESCRIPTION OF DRAWINGS

FIG. 5 shows results of an experiment from which a Relational Expression 1 has been derived.

DESCRIPTION OF EMBODIMENTS

The following describes preferred embodiments of the present invention with reference to the drawings.

First Embodiment

Structure of Lighting Apparatus

Figure 1:
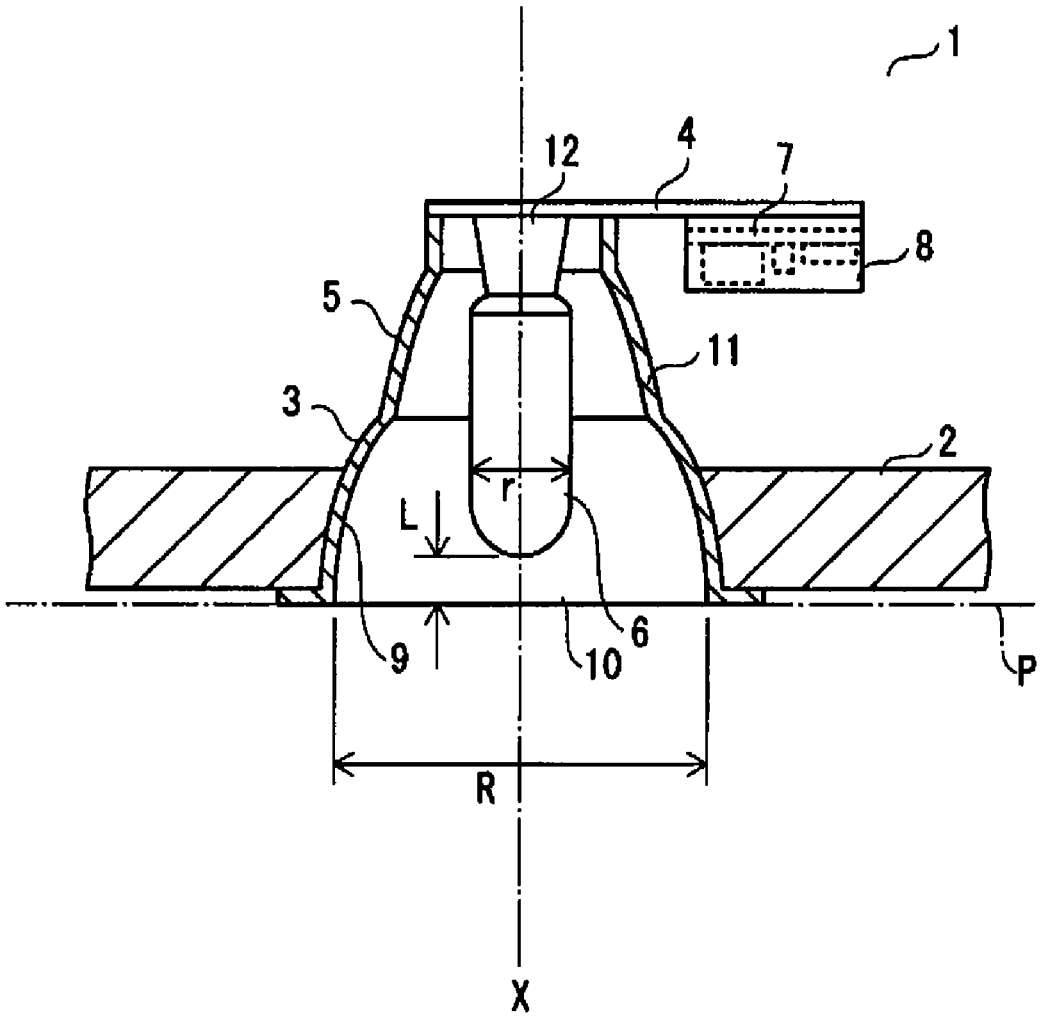
FIG. 1 is a front view, partially broken away, of a lighting apparatus that is a first embodiment of the present invention.

A lighting apparatus 1 that is a first embodiment of the present invention is used for a downlight for example, and includes a main body unit 5, a metal halide lamp 6 (hereinafter just "lamp 6"), and a feeding unit 8, as shown in FIG. 1. The main body unit 5 includes a lighting fixture 3 built into a ceiling 2 and a plate-like basis part 4 attached to a bottom surface of the lighting fixture 3. The lamp 6 is provided inside the main body unit 5, and has a rated wattage of 100 [W] for example. The feeding unit 8 includes a known electronic ballast 7 attached to the basis part 4 so as to be separate from the lighting fixture 3.

Note that, instead of the electronic ballast 7, a magnetic ballast is sometimes used depending on the specification and the like of the lamp.

(Lighting Fixture)

The lighting fixture 3 includes a mirror part 11 having a concave reflective surface 9 and a socket part 12 provided inside the mirror part 11. The mirror part 11 causes the reflective surface 9 to reflect light that is emitted from the lamp 6 provided inside thereof, and emits the light through an opening 10 of the mirror part 11 (light extraction part). This lighting fixture 3 is characterized in being an opening-type one especially in which a front glass for closing is not attached to the mirror part 11. A metal film or the like is deposited on the reflective surface 9 by evaporation.

Here, only in the case where the lamp is compact, when an opening diameter of the mirror part 11 is represented as R [mm], a relational expression $R \leqq 130$ is satisfied. The "opening diameter" here indicates an inner diameter of an end surface of the mirror part 11 in a light emitting direction.

Note that the shape and so on of the lighting fixture 3 are appropriately determined depending on its application, use conditions, and the like.

(Lamp)

Figure 2:
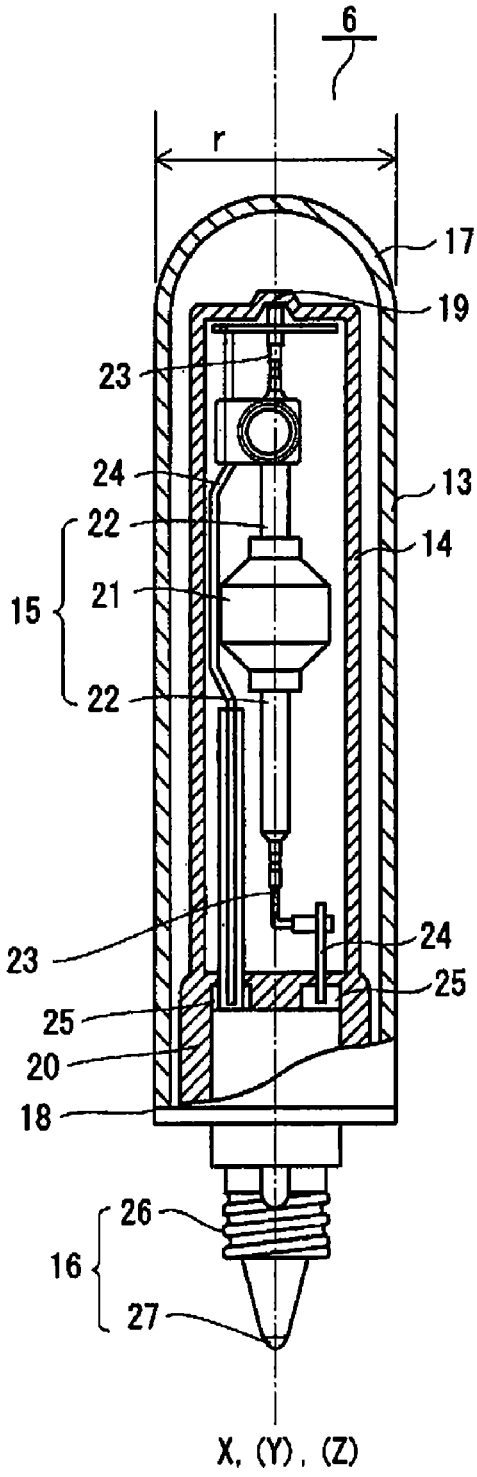
FIG. 2 is a front view, partially broken away, of a metal halide lamp used for the lighting apparatus.

The lamp 6 includes, as shown in FIG. 2, an outer tube 13, an inner tube 14 housed inside the outer tube 13, an arc tube 15 arranged in an airtight space inside the inner tube 14, and a base 16 attached to an end part of the outer tube 13 such as an E-shaped base.

The base 16 is not limited to the E-shaped base shown in FIG. 2. Alternatively, it may be possible to employ bases having known various types of shapes such as a pin-like swan base and a G-shaped base. Different from the case where the E-shaped base is employed, it is especially preferable that a lamp employing a swan base cannot be detached unless a predetermined rotary torque is applied to the socket part 12 in order to prevent unforeseen drop-off of the lamp. Specifically, the rotary torque is preferably 0.3 [Nm] or greater.

A central axis X of the outer tube 13 in a longitudinal direction, a central axis Y of the inner tube 14 in a longitudinal direction, and a central axis Z of the arc tube 15 in a longitudinal direction are substantially the same. Note that being "substantially the same" includes a case where the central axes X, Y, and Z are misaligned with one another due to unevenness caused during assembly of these tubes 13, 14, and 15, in addition to a case where the central axes X, Y, and Z are exactly the same.

The outer tube 13 is made of hard glass for example, and is substantially cylindrical except one end thereof. The one end of the outer tube 13 is closed (closed part 17), and the other end of the outer tube 13 is open (opening 18). The closed part 17 has an external surface having a continuous or discontinuous curved shape such as substantially a hemispherical shape. The outer tube 13 contains an ambient atmosphere (except inside of the inner tube 14 and the arc tube 15).

Here, only in the case where the lamp is compact, when the maximum outer diameter of the outer tube 13, specifically an outer diameter the a substantially cylindrical part of the outer tube 13 shown in FIG. 2 is represented as r [mm], a relational expression $22 \leqq r \leqq 28$ is satisfied.

The outer tube 13 is not limited to the above-described straight outer tube whose external shape is substantially cylindrical except one end thereof. Alternatively, it may be possible to employ outer tubes having known various types of shapes. For example, it may be possible to employ an outer tube in which only a central part is protruding outwardly. Also, it may be possible to employ an outer tube in which a central part is protruding most outwardly and an outer diameter of the outer tube continuously decreases towards both ends thereof. Anyway, the maximum outer diameter of an outer tube having any of known various types of shapes is represented as "r".

The inner tube 14 is made of quartz glass for example, and is substantially cylindrical except both ends thereof. The inner tube 14 has a tip-off part 19, which is a remnant part of an exhaust tube, on a center part of the one end that is substantially planar, and has a sealing part 20 on the other end, which has been crushed and sealed by a known pinch sealing method. The inside of the inner tube 14 is airtight space such as a vacuum atmosphere.

The inner tube 14 is not limited to the above-described straight inner tube whose external shape is substantially cylindrical except both ends thereof. Alternatively, it may be possible to employ inner tubes having known various types of shapes. For example, it may be possible to employ an inner tube in which only a central part is protruding outwardly. Also, it may be possible to employ an inner tube in which a central part is protruding most outwardly and an outer diameter of the inner tube continuously decreases towards both ends thereof.

The arc tube 15 is composed of an envelope made of translucent ceramics such as polycrystalline alumina, and includes a main tube part 21 and a thin tube part 22 formed on each of ends of the main tube part 21.

According to the example shown in FIG. 2, the lamp 6 has the structure in which the main tube part 21 and the thin tube parts 22 are separately formed, and then the main tube part 21 and the thin tube parts 22 are integrated together by shrinkage fitting. However, the shape and the structure of the lamp 6 are not limited to those shown in the example of FIG. 2. Alternatively, it may be possible to employ a lamp in which a main tube part and thin tube parts are integrally formed. That is, it may be possible to employ arc tubes having known various types of shapes and structures.

The main tube part 21 has a pair of electrodes (not shown) arranged therein, and includes therein metal halide, rare gas, and mercury each having a predetermined amount. Use examples of the metal halide include sodium iodide and dysprosium iodide.

Each of two feeders 23 has an electrode attached thereto at one end part thereof. The one end part of each of the feeders 23 is inserted into a corresponding one of the thin tube parts 22, and is sealed with one of end parts of each of the thin tube parts 22 that is opposite to the other end part integrated with the main tube unit 21 by a sealing member made of frit (not shown). The other end part of each of the feeders 23, which is opposite to the one end part to which the electrode is attached, projects outward from the thin tube part 22, and is electrically connected to a power feed line 24. The power feed line 24 is electrically connected to external lead wires (not shown) via a metal foil 25 sealed by the sealing part 20. One of the lead wires is electrically connected to a shell part of the base 16. The other lead wire is electrically connected to an eyelet part 27 of the base 16.

Note that the power feed line 24 is not necessarily composed of a single metal wire, and is sometimes composed of a plurality of metal wires that have been connected to one another and integrated together.

(Relationship Between Lighting Fixture and Lamp)

Next, the relationship between the lighting fixture 3 and the lamp 6 is described.

In the state where the lamp 6 is attached to the inside of the lighting fixture 3 (as shown in FIG. 1), when the maximum outer diameter of the outer tube 13 is represented as r [mm] and the opening diameter of the mirror part 11 included in the lighting fixture 3 is represented as R [mm], a ratio (R/r) of the opening diameter "R" to the maximum outer diameter "r" satisfies the following relational expression:

$$3.5 \leqq R/r \qquad \text{(Relational Expression 1)}$$

When the ratio (R/r) is low, a user has difficulty inserting his thumb and fingers into a space between the lighting fixture 3 and the lamp 6, and cannot firmly grasp the lamp 6 between the thumb and fingers. This results in impossibility to turn the lamp 6 using a predetermined rotational torque. As a result, the lighting apparatus 1 has the structure in which lamp replacement is difficult. The inventors conducted an experiment, which is described later. A result of the experiment proved that satisfaction of the Relational Expression 1 facilitates the user to insert his thumb and fingers into the space between the lighting fixture 3 and the lamp 6, and enables turn of the lamp using the predetermined rotational torque thereby to facilitate lamp replacement.

Here, as shown in FIG. 1, a planar surface including the end surface of the opening 10 of the mirror part 11 is set as a reference surface P, and a distance between the reference surface P and a tip of the lamp 6 is set as L [mm]. The result of the experiment also proved that when the relational expression 1 is satisfied and further when a relational expression $0 \leqq L \leqq 15$ is satisfied, lamp replacement is further facilitated.

Moreover, the experiment proved the following. When the tip of the lamp is located outside the reference surface P against the mirror part 11 ($L<0$) and the whole cylindrical part of the outer tube 13 except the closed part 17 is located inside the reference surface P against the mirror part 11, lamp replacement is easily performed.

(Lamp Replacement)

Consider the case where the lamp 6 reaches the end of its working life, and as a result the lighting apparatus 1 having the above structure become unavailable, and then the lamp 6 needs to be detached for replacement. The lighting fixture 3 is an opening type one in which no front glass is attached. Accordingly, the user generally inserts his hand inside the lighting fixture 3 through the opening 10, and grasps around the end part of the outer tube 13, thereby to turn the lamp 6 so as to be detached. Also, when attaching a replacing lamp 6, the user grasps around the end part of the outer tube 13, inserts the lamp inside the lighting fixture 3, and screws the base 16 into the socket part 12 so as to be attached.

However, if the user cannot firmly grasp the lamp 6 (outer tube 13) between the thumb and fingers inserting inside the mirror part 11 through the opening 10, the user has difficulty turning the lamp 6. This makes lamp replacement difficult.

Figure 3A:
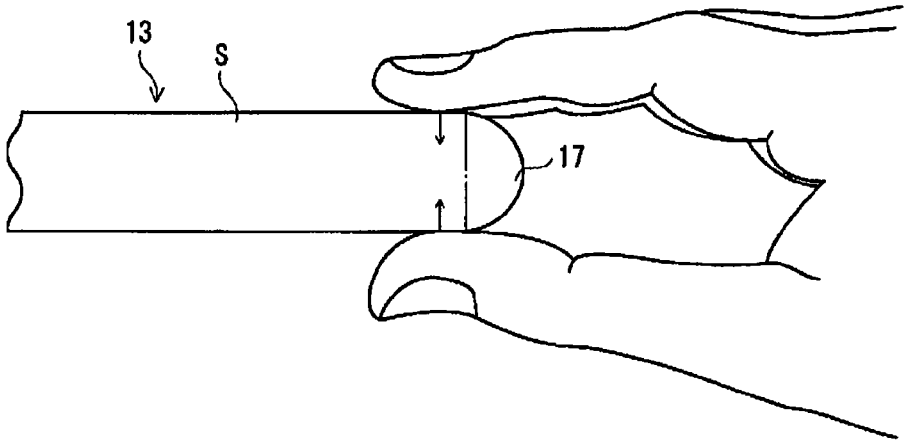
FIG. 3A and FIG. 3B are each a pattern diagram showing a position to grasp the lamp.
Figure 3B:
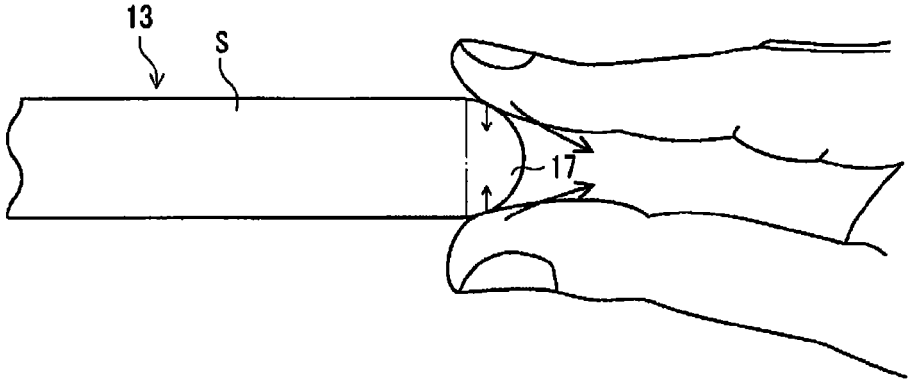

FIG. 3A and FIG. 3B are each a pattern diagram showing a position to grasp the lamp (outer tube). As shown in FIG. 3A, the user can strongly grasp the outer tube 13 between the thumb and fingers at a position of a cylindrical part S, and accordingly can firmly grasp the outer tube 13.

On the other hand, as shown in FIG. 3B, the stronger the user grasps the outer tube 13 between the thumb and fingers at a position of the hemisphere closed part 17, the more the thumb and fingers slide along a curved surface of the closed part 17. As a result, the user cannot firmly grasp the outer tube 13. Accordingly, in order to turn the lamp using a predetermined rotational torque, it is necessary to grasp the cylindrical part S of the outer tube 13.

Figure 4:
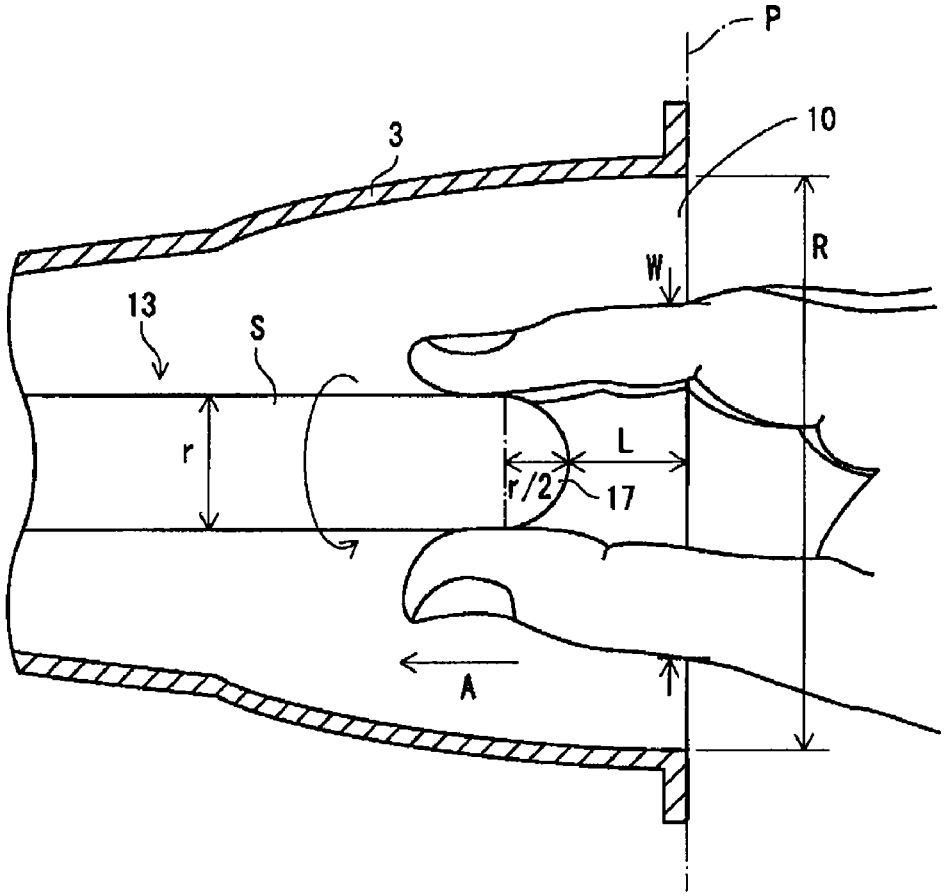
FIG. 4 is a pattern diagram showing a positional relationship among a lighting fixture, the lamp, and a user's hand (thumb and fingers) inserting inside the lighting fixture.

FIG. 4 is a pattern diagram showing a positional relationship among the lighting fixture 3, the lamp 6 (outer tube 13), a user's hand (thumb and fingers) inserting inside the lighting fixture 3.

FIG. 4 shows that the user grasps the cylindrical part S of the outer tube 13 between his thumb and fingers inserting inside the lighting fixture 3. Also, a width "W" indicates the maximum outer width between the thumb and other fingers passing through the reference surface P.

In FIG. 4, the tip of the cylindrical part S is located at a distance of L+r/2 from the reference surface P. For example, if the maximum outer diameter r of the outer tube 13 is increased without changing the distance L, the tip of the cylindrical part S moves inwardly to the lighting fixture 3 (in a direction indicated by an arrow A). As a result, in order to grasp the cylindrical part S, the user needs to insert his hand (thumb and fingers) more inwardly to the lighting fixture 3. This increases the maximum outer width W between the thumb and other fingers passing through the reference surface P.

Therefore, the larger the maximum outer diameter r of the outer tube 13 is, the larger opening diameter R of the lighting fixture 3 needs to be.

<Experiment from which Relational Expression 1 has been Derived>

The following describes the experiment from which the Relational Expression 1 has been derived.

In the experiment, the inventors of the present invention prepared a plurality of combinations using different ratios (R/r) of the opening diameter R of the lighting fixture 3 to the maximum outer diameter r of the outer tube 13, and measured a rotational torque for each of the combinations with respect to turn of the outer tube 13. Specifically, five types of outer tubes 13 were manufactured, which each have the maximum outer diameter of 20 [mm], 22 [mm], 25 [mm], 28 [mm], and 30 [mm]. Five and four Comparative Examples were prepared for the outer tubes 13 each having the maximum outer diameter of 20 [mm] and 30 [mm], respectively. Three Examples and one Comparative Example were prepared for each of the outer tubes 13 each having the maximum outer diameter of 22 [mm], 25 [mm], and 28 [mm]. Note that in each of the Examples and Comparative Examples, the distance L (see FIG. 1) between the reference surface P and the tip of the outer tube 13 is set to 15 [mm].

FIG. 5 shows a result of the experiment from which the Relational Expression 1 has been derived.

FIG. 5 shows a maximum outer diameter r, an opening diameter R, a ratio (R/r), a rotational torque [Nm], and a judgment result, with respect to each of the Examples and Comparative Examples.

In the experiment, when the rotational torque is 0.3 [Nm] or greater, lamp replacement is judged to "easy". When the rotational torque is less than 0.3 [Nm], lamp replacement is judged to "difficult".

The following describes the reason why the lamp replacement is judged to easy or difficult based on the value of the rotational torque of 0.3 [Nm]. A rotational torque of approximately 0.1 to 0.2 [Nm] is enough for attaching and detaching a lamp having an E-shaped base to and from a socket. Also, a rotational torque of approximately 0.3 [Nm] is enough for attaching and detaching a lamp having a swan base to and from a socket. Accordingly, when the rotational torque is 0.3 [Nm] or greater, it is possible to certainly attach and detach a lamp to and from a socket.

According to the experiment results, with respect to each of the Comparative Examples 1 to 5 for example, the maximum outer diameter of r=20 [mm] is used as shown in FIG. 5. With respect to the Comparative Example 1, R=68 [mm], R/r=3.4, and rotational torque=0.30 [Nm] are used, a judgment result indicates "easy". With respect to each of the Comparative Examples 2 to 5, a judgment result indicates "easy" in the same way as the Comparative Example 1.

Also, FIG. 5 shows a judgment result with respect to each of the Comparative Examples and Examples in which the maximum outer diameters r=22, 25, 28, and 30 [mm] are used.

As shown in FIG. 5, with respect to each of the Comparative Examples and Examples in which the maximum outer diameters of 20 [mm] and 30 [mm] are used, a judgment result indicates "easy" regardless of the value of the ratio (R/r) of the opening diameter R to the maximum outer diameter r. On the other hand, with respect to each of the Comparative Examples and Examples in which the maximum outer diameters of 22 [mm] to 28 [mm] are used and the ratio (R/r) is 3.5 or greater, a judgment result indicates "easy". With respect to each of the Comparative Examples and Examples in which the maximum outer diameters of 22 [mm] to 28 [mm] are used and the ratio (R/r) is less than 3.5, a judgment result indicates "difficult". Accordingly, the result of the experiment proved that the lower limit of the ratio (R/r) needs to have a value such that a rotational torque of 0.3 [Nm] or greater is applied to the lighting fixture 3 including the outer tube 13 whose maximum outer diameter r is 22 to 28 [mm].

The following describes the lower limit of the ratio (R/r).

Figure 6:
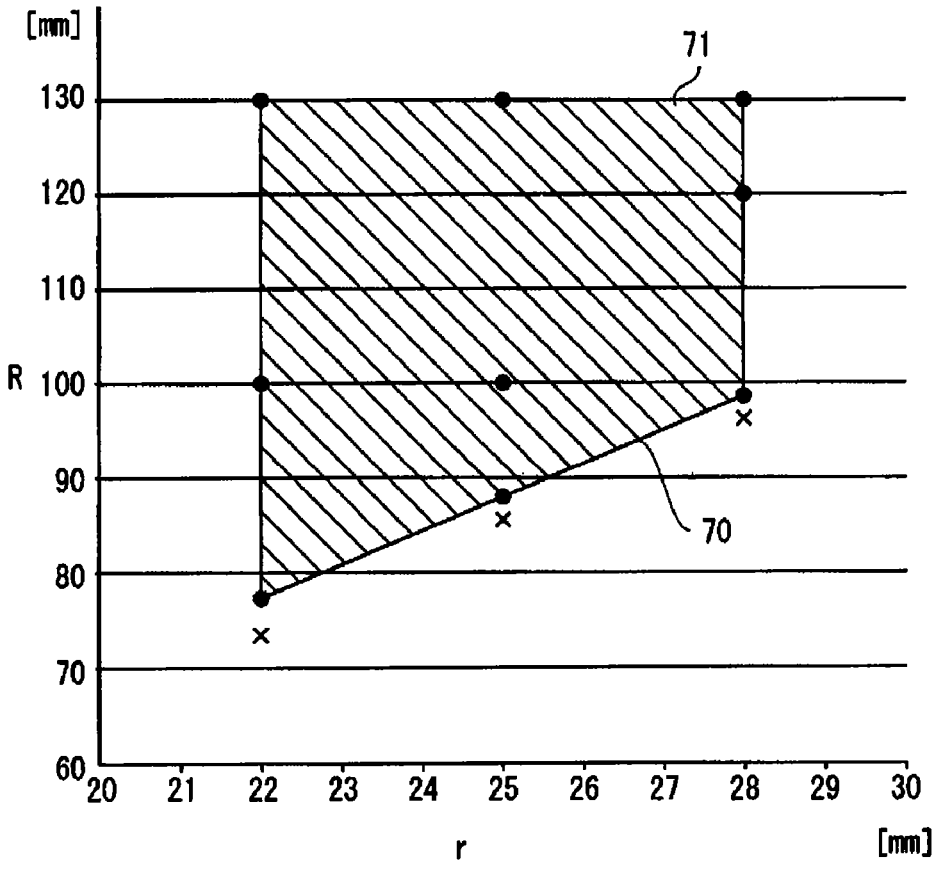
FIG. 6 shows a relationship between an outer diameter of an outer tube and an opening diameter of a mirror part of the lighting fixture.

FIG. 6 shows a plot of the Examples and the Comparative Examples shown in FIG. 5 in which the maximum outer diameters of 22 to 28 [mm] are used, with the vertical axis and the horizontal axis representing the outer diameter R and the maximum outer diameter r, respectively. The Examples whose judgment results indicate "easy" are each represented by a mark "•", and the Comparative Examples whose judgment results indicate "difficult" are each represented by a mark "x".

Also, in FIG. 6, a line 70 is formed by connecting the marks "•" representing judgment results "easy" whose ratio R/r each have a value (R/r=3.5) closest to a ratio R/r having a value judged to "difficult" represented by the marks "x", for each maximum outer diameter r.

This line 70 represents the lower limit of the opening diameter R with respect to the maximum outer diameter r. Therefore, in order to apply a rotational torque of 0.3 [Nm] or greater, the ratio (R/r) of the opening diameter R to the maximum outer diameter r needs to be 3.5 or greater.

Also, in FIG. 6, an area 71 is formed by connecting the marks "•" representing judgment results "easy" with respect to the Examples.

Even if the outer tube 13 having the maximum outer diameter r of 20 [mm] or 30 [mm] has the ratio (R/r) of less than 3.5, it is possible to apply a rotational torque of 0.3 [Nm] or greater for the following reason.

An outer tube having the maximum outer diameter r of 20 [mm] has a small semispherical closed part at a tip thereof, and accordingly the user easily grasps a cylindrical part of the outer tube. This makes it easy to apply a rotational torque of 0.3 [Nm] or greater for lamp replacement.

On the other hand, in the case of an outer tube having the maximum outer diameter r of 30 [mm], there is a large space between the outer tube and the lighting fixture. Accordingly, the user easily inserts his hand inside the lighting apparatus to easily grasp a cylindrical part of the lighting fixture. This also makes it easy to apply a rotational torque of 0.3 [Nm] or greater for lamp replacement.

The result of the experiment proved that when the lighting apparatus 1 satisfies the following conditions, it is possible to apply, to the outer tube 13, a predetermined rotational torque necessary for lamp replacement: 22≦the maximum outer diameter r≦28; the opening diameter R≦130; and the Relational Expression 1. Accordingly, with a space allowance between the lighting fixture 3 and the lamp 6 (outer tube 13), the user can apply a force with his thumb and fingers, thereby to turn the lamp 6 using a predetermined rotational torque. This facilitates attachment and detachment of the lamp 6. Accordingly, it is possible to realize the lighting apparatus 1 that is compact and excellent in lamp replacement.

Especially, in order to enable easier detachment and attachment of the lamp 6, a relational expression 25≦r is preferably satisfied.

Also, when a swan base is used as described above, there is a case where a predetermined high rotational torque (of 0.3 [Nm] or greater) is necessary for detaching the lamp. Even in such a case, it is possible to ensure the facility of lamp replacement.

According to the lighting apparatus 1 having the above structure, it is possible to more easily perform lamp replacement by appropriately adjusting the distance L such that the relational expression 0≦L≦15 is satisfied, in addition to setting the ratio (R/r) as above described.

Also, according to the lighting apparatus 1 having the above structure, even if the relational expression 0≦L≦15 is not satisfied, it is possible to easily perform lamp replacement by satisfying a relational expression (−r/2≦L<0), in addition to setting the ratio (R/r) as above described. The relational expression (−r/2≦L<0) specifically indicates that the tip of the closed part 17 is located in a position which is outside the mirror part 11 against the reference surface P and is distant of half or less of the maximum outer diameter r from the reference surface P. In this case, the depth of the mirror part 11 can be decreased, and accordingly the lighting fixture 3 can be further downsized. Note that when the outer tube 13 has the closed part 17 that is not semispherical, the closed part 17 has a length in the direction of the central axis X at a maximum.

Second Embodiment

Figure 7:
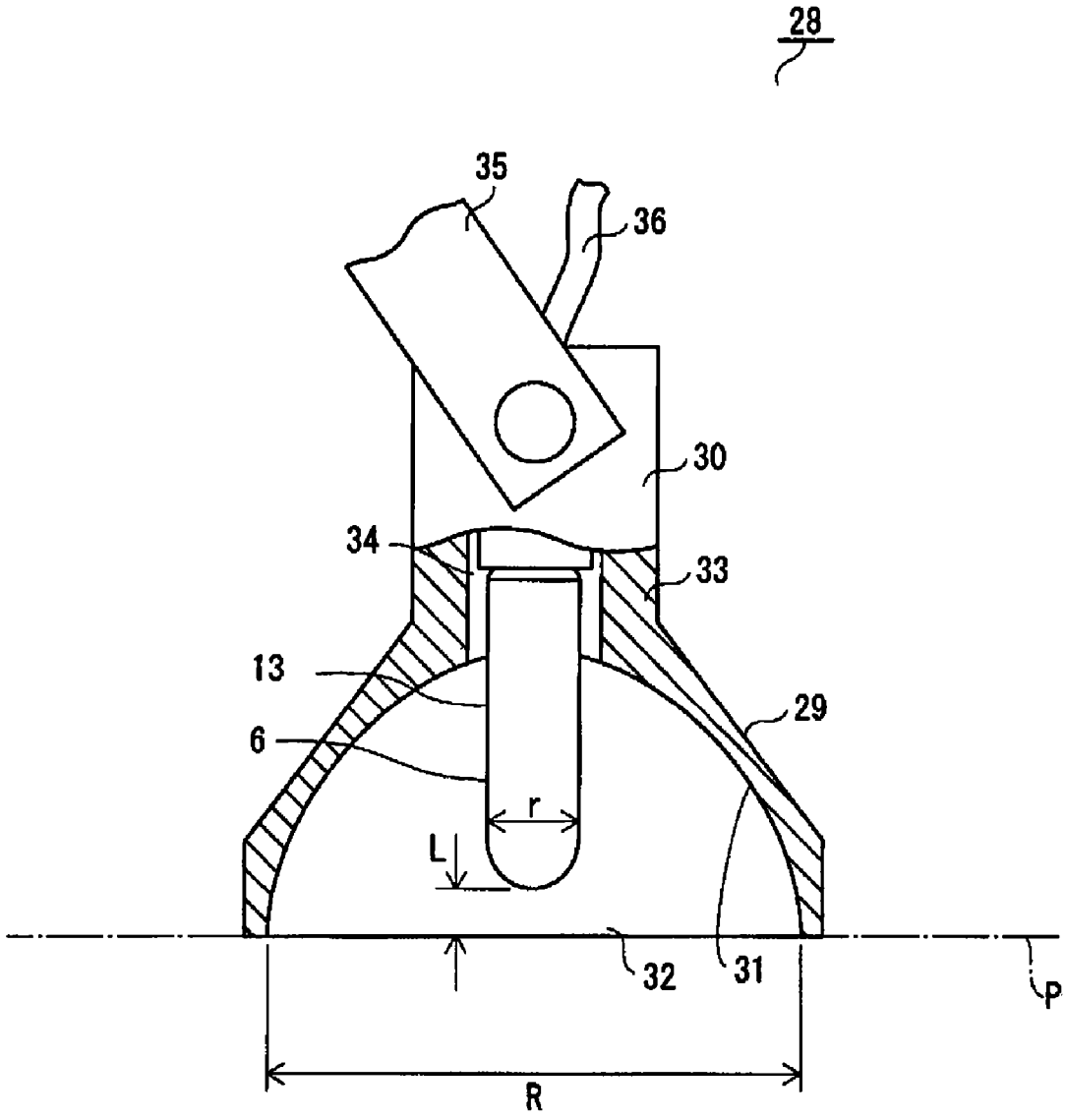
FIG. 7 is a front view, partially broken away, of a lighting apparatus that is a second embodiment of the present invention.

Next, a lighting apparatus 28 that is a second embodiment of the present invention is used for a spotlight for example. The lighting apparatus 28 includes, as shown in FIG. 7, a main body unit 30, the metal halide lamp 6 attached to the inside of the main body unit 30, and a feeding unit (not shown) having an electronic ballast for lighting the lamp 6. The main body unit 30 includes a lighting fixture 29 that is attachable to a ceiling, a wall, or the like (not shown). The lamp 6 is the same as that used for the lighting apparatus of the first embodiment of the present invention, and has a rated wattage of 100 [W] for example.

The lamp 6 of the second embodiment has the same structure of the lamp of the first embodiment, and accordingly description thereof is omitted here. Note that, instead of the electronic ballast, a magnetic ballast is sometimes used depending on the specification and the like of the lamp.

The lighting fixture 29 includes a mirror part 33 having a concave reflective surface 31 and a socket part 34 provided inside the mirror part 33. The mirror part 33 causes the reflective surface 31 to reflect light emitted from the lamp 6 provided inside thereof, and emits the light via an opening 32 of the mirror part 33 (light extraction part). This lighting fixture 29 is characterized in being an opening-type one especially in which a front glass for closing is not attached to the mirror part 33. A metal film or the like is deposited on the reflective surface 31 by evaporation.

In FIG. 7, a referential numeral 35 represents an arm part for attaching the mirror part 33 to a ceiling, a wall, or the like, and a referential numeral 36 represents a feed line for connecting the socket part 34 with the electronic ballast.

Note that the shape and so on of the lighting fixture 29 are appropriately determined depending on its application, use conditions, and the like.

In the state where the lamp 6 is attached to the inside of the lighting fixture 29, when a maximum outer diameter of the outer tube 13 is represented by r [mm] and an opening diameter of the mirror part 33 included in the lighting fixture 29 is represented by R [mm], the following relational expressions are satisfied: $22 \leqq r \leqq 28$; $R \leqq 130$; and $3.5 \leqq R/r$.

In other words, when the relational expressions $22 \leqq r \leqq 28$ and $R \leqq 130$ are satisfied as described above, it means that the lighting apparatus 28 is a considerably downsized one. Accordingly, when the user inserts his thumb and fingers into a space between the lighting fixture 29 and the lamp 6, there remains little room in the space. As a result, in such a state, even if the user tries to apply a predetermined rotational torque in order to turn the lamp 6, the user has difficulty applying a force with his thumb and fingers.

In view of this, when the relational expression $3.5 \leqq R/r$ is satisfied in addition to the relational expressions $22 \leqq r \leqq 28$ and $R \leqq 130$, the user can insert the thumb and fingers into the space between the lighting fixture 29 and the lamp 6 with some sufficient room. This sufficient room allows the user to apply a force with the thumb and fingers and apply a predetermined rotational torque to the lamp 6 so as to be rotated. This facilitates attachment and detachment of the lamp 6. Therefore, it is possible to realize the lighting apparatus 28 that is compact and has an excellent maintenance property in which lamp replacement is easily performed.

Especially, in order to enable easier detachment and attachment of the lamp 6, it is preferable to satisfy a relational expression $25 \leqq r$. Also, in order to enable easier detachment and attachment of the lamp from and to the lighting fixture, it is preferable to appropriately adjust the position of the tip part of the lamp with respect to the reference surface P. Specifically, it is preferable to set the distance L between the reference surface P and the tip of the lamp to 15 mm or less, as shown in FIG. 7.

The lighting apparatus shown in FIG. 7 has the structure in which the tip part of the lamp is located inside the lighting fixture against the reference surface P. However, the present invention is not limited to this structure. Alternatively, it may be possible to employ a structure in which the tip part of the lamp is located outside the lighting fixture against the reference surface P.

Although the lighting apparatus according to the present invention has been described based on the embodiments, the present invention is not limited to these embodiments.

Modification Examples (1) In the above embodiments, the descriptions have been made with use of the examples of the metal halide lamp 6 having a rated wattage of 100 [W], for example. However, the present invention is not limited to a metal halide lamp having a rated wattage of 100 [W]. Alternatively, when the present invention is applied to a metal halide lamp having a rated wattage in the range of 35 [W] to 130 [W], it is also possible to achieve the effect that is the same as above.

(2) Also, in the above embodiments, a downlight and a spotlight are given as application examples of the lighting apparatus. However, application of the lighting apparatus of the present invention is not limited to these examples. Alternatively, the present invention may be applicable to other lights such as an interior light and a street light.

(3) In the above embodiments, the metal halide lamp has been described as including an E-shaped base. Alternatively, the metal halide lamp may include a swan base. For example, it may be possible to employ a metal halide lamp 106 including a swan base 40 for the lighting apparatus 1, such as shown in FIG. 8A.

Figure 8A:
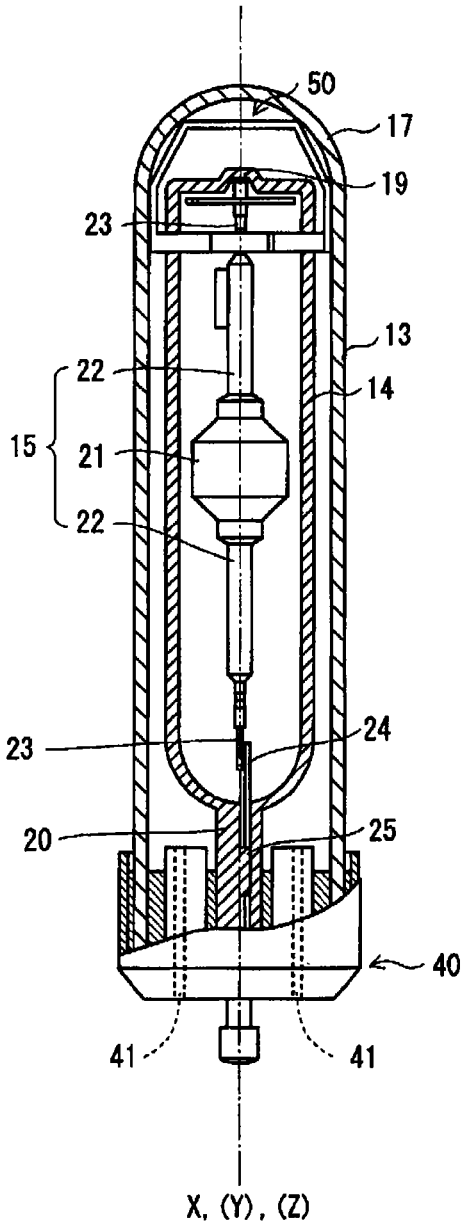
FIG. 8A and FIG. 8B are each a front view, partially broken away, of a metal halide lamp that is a modification example.

(4) Also, the base of the lamp may include air vents 41 which are in communication with the inside of the outer tube 13 and the external space, such as shown in FIG. 8A. Provision of such air vents 41 prevents collection of liquid discharged from cement which is used for adhering the outer tube to the base or the like. This can prevent deterioration in appearance quality of the lamp due to adhesion of liquid to the inside of the outer tube.

Figure 8B:
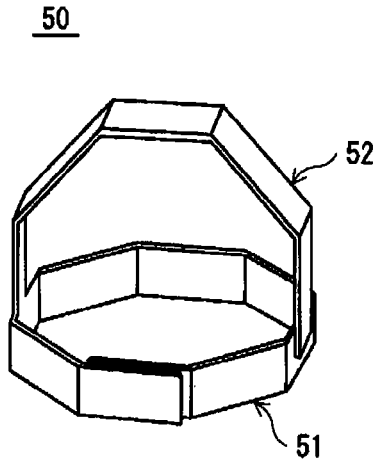

(5) The metal halide lamps according to the above embodiments each may include a restriction member for preventing misalignment between the central axis of the outer tube and the central axis of inner tube. Specifically, as shown in FIG. 8A, a restriction member 50 may be provided between the outer tube 13 and the inner tube 14. FIG. 8B is a perspective view showing the restriction member 50. The restriction member 50 includes a circular part 51 and a U-shaped part 52 attached to the circular part 51. Note that the shape of the restriction member is not limited to the shape of the restriction member 50 shown in FIG. 8B. For example, a C-shaped curved member may be employed instead of the circular part 51. Also, a member having a J-shape or an L-shape may be employed instead of the U-shaped part 52. It may be possible to appropriately select the shape of the restriction member depending on the specification or application of the metal halide lamp.

(6) It may be possible to perform frost process on an inner surface of the outer tube of the lamp by chemical treatment such as hydrofluoric acid treatment. It is possible to diffuse light by the outer tube on which frost process has been performed. This enables reduction in unevenness of light emitted from the arc tube.

INDUSTRIAL APPLICABILITY

The present invention is applicable to an intended purpose of necessity a compact lighting apparatus that is compact yet easy in lamp replacement.

REFERENCE SIGNS LIST

1 and 28: lighting apparatus
2: ceiling
3 and 29: lighting fixture
4: basis part
5 and 30: main body unit
6: metal halide lamp
7: electronic ballast
8: feeding unit
9 and 31: reflective surface
10 and 32: opening
11 and 33: mirror part
12 and 34: socket part
13: outer tube

14: inner tube
15: arc tube
16: base
17: closed part
18: opening
19: tip off part
20: sealing part
21: main tube part
22: thin tube part
23: feeder
24: power feed line
25: metal foil
26: shell part
27: eyelet part
35: arm part
36: feed line

The invention claimed is:

1. A lighting apparatus comprising:

a metal halide lamp that includes an outer tube, an inner tube provided inside the outer tube, and an arc tube provided inside the inner tube; and an open-type lighting fixture that includes a mirror part having a concave reflection surface inside which the metal halide lamp is disposed, the mirror part reflecting light emitted from the metal halide lamp at the reflection surface such that the reflected light is emitted through an opening of the mirror part, wherein the metal halide lamp is attached to the lighting apparatus by turning an axis of the metal halide lamp in a longitudinal direction as a rotational axis, the outer tube has a cylindrical part and a curved part that is spherical, the curved part is in connection with an end of the cylindrical part in an axial direction thereof on a side of the opening of the mirror part so as to close the end, relational expressions $22 \leqq r \leqq 28$, $R \leqq 130$, and $3.5 \leqq R/r$ are satisfied, with r denoting a maximum outer diameter [mm] of the curved part in a direction perpendicular to the axial direction, and R denoting an opening diameter [mm] of the mirror part.

2. The lighting apparatus of claim 1, wherein the curved part is semispherical.

3. The lighting apparatus of claim 1, wherein a relational expression $0 \leqq L \leqq 15$ is satisfied, with L denoting a distance [mm] from an edge of the outer tube to a planar reference surface including an end surface of the mirror part in a light emitting direction.

4. The lighting apparatus of claim 2, wherein a relational expression $0 \leqq L \leqq 15$ is satisfied, with L denoting a distance [mm] from an edge of the outer tube to a planar reference surface including an end surface of the mirror part in a light emitting direction.

* * * * *